United States Patent [19]

Powers, III et al.

[11] Patent Number: 4,929,373

[45] Date of Patent: May 29, 1990

[54] PROCESS FOR PREPARING OVERBASED CALCIUM SULFONATES

[75] Inventors: William J. Powers, III; Leonard A. Matthews, both of Port Arthur, Tex.; Tze-Chi Jao, Fishkill, N.Y.

[73] Assignee: Texaco Inc., White Plains, N.Y.

[21] Appl. No.: 419,558

[22] Filed: Oct. 10, 1989

[51] Int. Cl.[5] ..... C10M 135/10

[52] U.S. Cl. ..... 252/33; 252/33.2; 252/33.4; 252/25

[58] Field of Search ..... 252/33, 33.2, 33.4, 252/18, 25, 39

[56] References Cited

U.S. PATENT DOCUMENTS

| | | | |
|---|---|---|---|
| 3,816,310 | 6/1974 | Hunt | 252/33.4 |
| 4,086,170 | 4/1978 | Clippeleir et al. | 252/33 |
| 4,427,559 | 1/1984 | Whittle | 252/33.2 |
| 4,597,880 | 7/1986 | Eliades | 252/33.4 |
| 4,604,219 | 8/1986 | Whittle | 252/33 |
| 4,615,841 | 10/1986 | Stamatakis et al. | 252/33 |
| 4,698,170 | 10/1987 | Le Coent | 252/33.2 |
| 4,749,499 | 6/1988 | Damin et al. | 252/33 |
| 4,780,224 | 10/1988 | Jao | 252/33 |
| 4,810,396 | 3/1989 | Jao et al. | 252/33 |

*Primary Examiner*—Jacqueline V. Howard
*Assistant Examiner*—Margaret B. Medley
*Attorney, Agent, or Firm*—Jack H. Park; Kenneth R. Priem; Richard A. Morgan

[57] ABSTRACT

In the preparation of an overbased calcium sulfonate, it has been found that adding the calcium hydroxide during the carbonation reaction reduced solid waste. An initial charge of 15 to 25 wt % of the total calcium hydroxide is added to initiate the carbonation reaction. The balance is added by a process whereby calcium hydroxide concentration remains low in the reaction admixture to reduce amorphous calcium carbonate residence time. In the process, calcium hydroxide is added in amounts whereby the molar ratio of carbon dioxide to the sum of calcium hydroxide and calcium oxide is about 0.8.

8 Claims, No Drawings

PROCESS FOR PREPARING OVERBASED CALCIUM SULFONATES

BACKGROUND OF THE INVENTION

This invention is an improved process for preparing overbased calcium sulfonates which are used as detergent and reserve alkalinity lubricating oil additives.

DESCRIPTION OF RELEVANT METHODS IN THE FIELD

In the course of operation, internal combustion engines convert lubricating oil to acidic degradation products. Those acidic degradation products attack and corrode engine parts and catalyze the formation of sludge, thereby reducing lubricity and accelerating wear of moving parts in contact with the lubricating oil.

It is desirable to add basic substances to the lubricating oil which neutralize acids as they are formed in the engine before they reach concentrations sufficient to cause corrosion or to catalyze the sludge reaction. Adding an alkalinity agent to the detergent in motor oil is known as overbasing. Colloidal carbonates of the alkaline earth metals have been found to be well suited for this purpose. These carbonate dispersions are stabilized by oil soluble surface active agents with the sulfonates of the alkaline earth metals in which the sulfonic acid portion of the molecule has a molecular weight of preferably 450 to 600. The sulfonates are made by sulfonation of lubricating oil fractions from petroleum and by sulfonation of alkyl benzenes having the desired molecular weight for this purpose. Benzene alkylates with straight chain alkyl groups are especially desirable.

In general the process of preparing oils which contain overbased calcium sulfonates comprises reacting a solution of alkylbenzene sulfonic acids having a molecular weight greater than 400, in oil with a slurry of calcium oxide or hydroxide and bubbling carbon dioxide through the reaction mixture; thereby incorporating an excess of calcium carbonate into the calcium sulfonate which confers reserve alkalinity to the product.

In this process it has been found advantageous to add a low molecular weight alcohol, such as methanol, and water to promote the formation of a micellar dispersion of calcium carbonate which is more readily incorporated into the calcium sulfonate.

Calcium hydroxide is not often used commercially as the sole reserve alkalinity agent. Calcium hydroxide, when used alone typically yields 45 to 60 vol % solids in the crude reaction product. The use of calcium oxide alone typically yields 5 to 15 vol % solids in the crude reaction product. However calcium oxide when used alone suffers from the disadvantage that it may yield a crystalline dispersed carbonate phase. For this reason it is advantageous in industrial practice to use a mixture of calcium hydroxide and calcium oxide as the reserve alkalinity agent. Such a method is described in U.S. Pat. No. 4,810,396 which is known to yield 15 to 25 vol % solids in the crude reaction product.

U.S. Pat. No. 4,427,559 to J. R. Whittle teaches that a mixture of calcium oxide and calcium hydroxide can be used in the overbasing reaction to provide reserve alkalinity to neutral calcium sulfonates. It is reported that when mixtures containing up to 30% CaO are used, satisfactory products were obtained. When mixtures of 30 to 50% CaO were used, a gelatinous material which plugged the filter was obtained. Concentrations of CaO above 70% produced a fluid product containing finely divided particles which could not be filtered and were reflective of light. In this regard the patent teaches the criticality of the ratio of the calcium oxide to calcium hydroxide in the absence of a promoter in producing acceptable products.

U.S. Pat. No. 4,604,219 to J. R. Whittle teaches that calcium oxide may be used as the sole reserve alkalinity source in overbasing calcium sulfonates. This patent teaches in the absence of a promoter, that water addition rate and amount are critical in producing a low solids content, filterable product.

U.S. Pat. No. 4,086,170 to De Clippeleir et al. teaches overbased calcium sulfonates are prepared by reacting a solution of alkylbenzene sulfonic acids with an excess of a calcium oxide having a medium or low activity toward water and with carbon dioxide. Improved overbasing and filterability of the overbased sulfonate solution were obtained by the use of a promoter for the conversion of the calcium oxide to calcium hydroxide. Recommended promoters include ammonia or organic bases such as monoamines or diamines, e.g. ethylene diamine.

U.S. Pat. No. 4,810,396 to T. C. Jao et al. teaches overbased calcium sulfonates are prepared by charging calcium oxide and water before carbonation. Calcium hydroxide is added with the calcium oxide in a specified ratio.

SUMMARY OF THE INVENTION

The invention is an improved process for preparing an overbased calcium sulfonate. Calcium sulfonates are overbased by diluting a neutral calcium sulfonate with a light hydrocarbon solvent and a low molecular weight alcohol. Next, water, calcium oxide and about 15 mole % to 25 mole % of the total calcium hydroxide is added. The admixture is heated to about 100° F. to 155° F. at 1 to 5 atm and carbonated for 1 to 4 hours. During carbonation the remaining calcium hydroxide is added to the admixture in a manner such that the residence time of unreacted calcium hydroxide is reduced to an industrially practical minimum. This is achieved by adding calcium hydroxide in amounts that the molar ratio of carbon dioxide to the sum of calcium hydroxide and calcium oxide is in the range of 0.65 to 0.90.

A diluent oil is then added and the admixture filtered. The liquid is stripped of light hydrocarbons and the resulting liquid product recovered.

An overbased calcium sulfonate characterized as low in filtered solids is thereby produced.

DESCRIPTION OF THE PREFERRED EMBODIMENTS

This invention is an improvement in U.S. Pat. No. 4,810,396 issued Mar. 7, 1989 to T. C. Jao and W. J. Powers, III.

In accordance with the invention, alkaline earth calcium sulfonates derived from natural or synthetic feedstocks or a mixture of both are overbased by controlled calcium hydroxide addition during the carbonation reaction. It has been found that introducing the calcium hydroxide continuously or in uniform increments during carbonation results in a crude liquid product with reduced solids.

The mechanism of the invention is not known with certainty. However, the characteristics of slurries of carbonated calcium hydroxide is well-known. Freshly carbonated slurries comprise amorphous calcium carbonate of relatively small particle size. As slurries age, amorphous calcium carbonate initiates crystal growth. Once seed crystals have been formed, more rapid crystal growth can take place. This rapid crystal growth is indicated by the auto heating of aging slurries as they loose heat of crystallization.

Slurries of calcium carbonate which have aged for longer periods of time have larger aggregations of crystals. Lesser aged slurries have smaller aggregations of crystals. Freshly slurried calcium carbonate contains amorphous calcium carbonate. Amorphous calcium carbonate is of a smaller particle size than crystalline calcium carbonate.

U.S. Pat. No. 4,615,813 issued Oct. 7, 1986 to J. Bretz incorporated herein by reference in its entirety reports x-ray diffraction and election microscope studies performed on colloidal calcium carbonate which has been allowed to crystallize. The reported size of calcium carbonate crystals was 40 to 50 Angstroms and interplanar spacing (dA.) of 3.035. X-ray diffraction study of an overbased organic material showed that none of the 40 to 50 Angstrom crystalline calcium carbonate had been incorporated. The calcium carbonate incorporated into the overbased material was amorphous and not crystalline.

Applicants theorize that the size of calcium carbonate produced from a freshly carbonated slurry of calcium hydroxide better matches the size of sulfonate micelles than aged calcium carbonate slurries. Accordingly, more of the fresh, amorphous calcium carbonate can be incorporated by the sulfonate micelles. Crystalline aggregates of calcium carbonate are a significant portion of the solid waste in the crude product.

Applicants have discovered that adding calcium hydroxide as continuously as industrially possible during the carbonation reaction reduces solid waste in the crude product. The calcium hydroxide is added at a rate whereby some is solubized by the sulfonate micelles and later converted to calcium carbonate, and some is carbonated to fresh calcium carbonate and incorporated immediately into the sulfonate micelles.

In a commercial size unit, the continuous addition of calcium hydroxide is difficult to accomplish. Applicants have found that adding calcium hydroxide in incremental amounts during carbonation is a sufficient approximation of a continuous method of producing fresh amorphous calcium carbonate at the same rate at which it is incorporated into the sulfonate micelles.

This incremental addition achieves the reduction in byproduct solids when carried out within the critical parameters of the invention. The calcium hydroxide is added at a rate whereby the molar ratio of carbon dioxide to the sum of calcium hydroxide and calcium oxide is in the range of 0.65 to 0.90, preferably 0.77 to 0.80. Over carbonation is thereby avoided and unrecoverable product reduced.

In carrying out the invention, the inventive parameters are maintained within their limits by the instructed attention of a trained process technician. The process technician would set the flow rate of carbon dioxide on a flow rate indicator and controller. The technician would then add equal weighed aliquots of calcium hydroxide in amounts and on a time schedule during carbonation to maintain the critical ratio of carbon dioxide to calcium hydroxide and calcium oxide. The technician would not add calcium hydroxide if the temperature exceeded about 150° F., regardless of the time schedule. Alternatively the process may be automated by means of an electronic ratio control. Mass flow indicators are installed on the two flowing streams. The flow rate of calcium hydroxide is reset according to carbon dioxide molar flow rate, calculated from the mass flow rate.

Materials

The term calcium sulfonate as used herein, refers to those sulfonates wherein the hydrocarbon portion of the molecule has a molecular weight in the range of about 700 to about 1400. These oil-soluble sulfonates can be either natural sulfonates derived from petroleum fractions or synthetic sulfonates derived from the alkylation of aromatic compounds or mixtures of natural and synthetic sulfonates. These synthetic sulfonates include alkyl sulfonates and alkylaryl sulfonates. The term alkyl includes cycloalkyl groups in the side chains attached to a benzene ring. The alkyl groups can be straight or branched chain. The alkylaryl radical can be derived from benzene, toluene, ethyl benzene, ortho xylene, meta xylene, para xylene or naphthalene.

A particularly preferred calcium sulfonate feedstock is a mixed petroleum/alkyl sulfonate of about 950 to 1100 molecular weight consisting of 40 wt % to 60 wt % petroleum sulfonate on an oil free basis. Commercially available calcium sulfonates are typically available as 40% to 60% concentrates in mineral oil. Such commercially available solutions are useful in the practice of this invention.

Solvents useful in the practice of this invention are moderately volatile hydrocarbons and hydrocarbon mixtures having atmospheric boiling points or boiling ranges below about 428° F. (220° C.). Examples of solvents which may be employed for this purpose include straight run gasoline, dehexanized raffinate gasoline, normal or mixed hexanes, normal or mixed heptanes, benzene, toluene and mixtures thereof. Preferred solvents have boiling ranges below about 275° F. (135° C.). A preferred solvent, commonly referred to as refinery heptane or crude heptane, is a nominal C7 mixture of predominantly aliphatic and cycloaliphatic hydrocarbons boiling in the range of 170° F. to 250° F.

The solvent is incorporated in an amount of about 35 to 65 wt %, preferably 40 to 55 wt % of the reaction mixture.

Low molecular weight alcohols as referred to herein include $C_1$ to $C_5$ normal and branched aliphatic alcohols. A preferred low molecular weight alcohol is a commercial grade of 99%+ purity methanol which can be used as received without treatment. The alcohol is added to the reaction mixture in an amount of about 4.7 to 7.2 wt %, preferably 4.8 to 5.8 wt %. In the overbased sulfonate process, it is economically desirable to recover and recycle methanol. In the recovery process it is desirable to dry the methanol to a content of less than 1 wt % water.

Examples of diluent oils include paraffin oils, naphthene oils and mixtures thereof. Examples include a pale oil or solvent neutral oil having a viscosity of 100 to 800 SUS at 40° C. A preferred diluent oil is a hydrofinished pale oil having a viscosity of 100 SUS at 40° C. The quantity of diluent oil used is the amount which is required for the final lube oil formulation, including the diluent oil which may be added with the neutral calcium sulfonate. The amount of diluent oil is typically 20 wt % to 60 wt % of final liquid product after solvent stripping.

The calcium hydroxide is preferably one derived from calcium oxide, having an available lime assay as calcium oxide of at least 70%. The preferred calcium oxide has a total slaking time of 5 to 50 minutes, preferably 8 to 20 minutes by ASTM C-110. The calcium oxide has a 3 minute temperature rise of 2° C. to 40° C., preferably 5° C. to 15° C. by ASTM C-110.

Process Conditions

In accordance with the invention, a neutral calcium sulfonate is diluted with a light hydrocarbon solvent and a lower alkanol. The hydrocarbon solvent comprises 35 to 65 wt % preferably 40 to 55 wt % of the total reaction mixture. The alkanol comprises 4.7 to 7.2 wt %, preferably 4.8 to 5.8 wt % of the total reaction mixture.

Water, calcium oxide and 15 to 25 mole % of the total calcium hydroxide is added to the reaction mixture. The water added is based on the amount of calcium oxide and is in an amount of 0.15 to 0.40 mole %, preferably 0.20 to 0.25 mole % of the calcium oxide. The calcium oxide is added in a mole ratio with the calcium hydroxide of 40:60 to 80:20, preferably 60:40 to 70:30 basis moles oxide:hydroxide.

The total amount of both calcium hydroxide and calcium oxide depends entirely on the degree of overbasing required of the final product. The inventive process is used to make products wherein the mole ratio of calcium carbonate:calcium sulfonate ranges from 15:1 to 25:1. Products ranging from about 10:1 to 20:1 are sold commercially.

The reaction mixture is heated in a heated stainless steel kettle with stirring to 100° F. to 155° F., preferably 135° F. to 150° F., at a pressure of 1 to 5 atm., preferably 1 to 3 atm.

The carbon dioxide required may be introduced into the mixture by blowing or bubbling the gas through the mixture by means of a flow control valve and mass flow indicator. The calcium hydroxide is added so that the molar ratio of carbon dioxide to calcium hydroxide and calcium oxide does not exceed 0.65 to 0.90. This may be carried out continuously. In industrial practice this may be carried out incrementally. In the incremental addition, carbon dioxide addition is measured by flow indicator. Calcium hydroxide addition is measured by weighing, such as in a galvanized pail on a Toledo scale. Applicants have found in an industrial scale unit that an initial calcium hydroxide charge of 15 to 25 mole % followed by 2 to 3 equal amount increments kept the reaction within the desired temperature and time limitation.

Increments of calcium hydroxide are added to the reaction mixture so that the material does not reside in excess. This is so that the calcium carbonate produced therefrom is not permitted a residence time which allows it to age and crystallize. The reaction is exothermic and progress of the reaction is followed by recording the temperature of the reaction mixture. The reaction temperature should be controlled so that it does not exceed about 150° F. during carbonation. Incremental amounts of calcium hydroxide are added to maintain the carbon dioxide ratio. The size of the increment should be small as industrially practical and certainly not so large that the 155° F. temperature limit is exceeded.

This invention is shown by way of Example.

EXAMPLE 1 (Comparative)

Example 1 was carried out according to the procedure of U.S. Pat. No. 4,810,396. The apparatus comprised a 10 gallon hot oil jacketed, stainless steel kettle equipped with a motor driven agitator, ring sparger and a vapor condensation and return system. The kettle was charged with a light hydrocarbon solvent commonly referred to as crude refinery heptane (49.1 parts by weight); a nominal 45% active oil solution of a neutral calcium sulfonate exhibiting an average molecular weight of about 1000 (17.7 parts by weight); calcium oxide (6.2 parts by weight); calcium hydroxide (5.4 parts by weight); methanol (6.5 parts by weight) and calcium chloride (0.1 parts by weight).

The agitator was started and the temperature adjusted to 105° F. Water (0.4 parts by weight) was added in a single portion. Reactor pressure was set at 5 psig (1.34 atm). The kettle was then heated to a temperature of 140° F. Carbon dioxide was then added through the sparger at a rate of 5.6 liter/minute for 177 minutes. After the completion of carbon dioxide addition diluent oil (8.4 parts by weight) was added and this crude reaction product was cooled to 120° F.

The crude reaction product contained 18 vol % solid material. The crude product was filtered and vacuum stripped of solvent. A clear, dark fluid syrup product was recovered. The product had a Total Base Number (TBN) of 400 and a calcium sulfonate content of 18.3 wt %.

EXAMPLES 2, 3 and 4

Examples 2, 3 and 4 were carried out in the same apparatus described in Example 1. The procedure described in Example 1 was modified only in the addition of calcium hydroxide during the carbonation reaction. Heating the reaction mixture to 105° F., addition of the water charge, followed by heating to 140° F. and carbon dioxide injection were the same. As seen from the data reported in the Table, Examples 2, 3 and 4 differed only in the number and timing of calcium hydroxide additions. The addition of calcium hydroxide during the carbonation reaction reduced the by-product solids yield.

TABLE

| Example Number | 1 | 2 | 3 | 4 |
|---|---|---|---|---|
| Initial Charge, parts by wt | | | | |
| Calcium sulfonate | 17.7 | 17.7 | 17.7 | 17.7 |
| Crude Heptane | 49.1 | 49.1 | 49.1 | 49.1 |
| Methanol | 6.5 | 6.5 | 6.5 | 6.5 |
| Calcium Oxide | 6.2 | 6.2 | 6.2 | 6.2 |
| Calcium Hydroxide | 5.4 | 2.7 | 1.8 | 1.35 |
| Calcium Chloride | 0.1 | 0.1 | 0.1 | 0.1 |
| Carbon Dioxide, parts by wt | 6.2 | 6.2 | 6.2 | 6.2 |
| Calcium Hydroxide During Carbonation | | | | |
| Number of Additions | 0 | 1 | 2 | 3 |
| Amounts, parts by wt | | | | |
| First | — | 2.7 | 1.8 | 1.35 |
| Second | — | — | 1.8 | 1.35 |
| Third | — | — | — | 1.35 |
| Hydroxide Addition Timing, minutes into $CO_2$ addition | | | | |
| First | 0 | 145 | 120 | 130 |
| Second | — | — | 150 | 150 |
| Third | — | — | — | 170 |
| $CO_2/(Ca(OH)_2 + CaO)$, molar | 0.77 | 0.77 | 0.77 | 0.77 |
| Diluent Oil, parts by wt | 8.4 | 8.4 | 8.4 | 8.4 |
| Results | | | | |
| Solids in Crude Product, Vol % (ASTM D-2273) | 18.3 | 12 | 10 | 10 |
| Stripped Product Tests | | | | |
| TBN (ASTM D-2896) | 400 | 397 | 420 | 417 |
| Ca sulfonate, wt % | 18.3 | 18.7 | 18.5 | 20.5 |

TABLE-continued

| Example Number | 1 | 2 | 3 | 4 |
|---|---|---|---|---|
| Appearance | All dark, clear, fluid syrups | | | |

$CO_2$ — carbon dioxide
CaO — calcium oxide
$Ca(OH)_2$ — calcium hydroxide
TBN (Total Base Number) = $\frac{\text{milligram KOH}}{\text{gram sample}}$ TBN is a measure of the overbasing of calcium sulfonate with 0 to 50 wt % CaO, $Ca(OH)_2$, $CaCO_3$ or mixture thereof.

While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. A process for preparing an overbased oil-soluble calcium sulfonate, comprising:
   (a) diluting a neutral calcium sulfonate with a light hydrocarbon solvent and a lower alkanol;
   (b) adding water, calcium oxide and about 15 to 25 mole % of the total calcium hydroxide;
   (c) heating the resulting admixture to about 100° F. to 155° F. at pressure of about 1 to 5 atm;
   (d) introducing carbon dioxide into the heated admixture over a time of about 60 to 240 minutes while adding the remaining calcium hydroxide in amounts whereby the molar ratio of carbon dioxide to the sum of calcium hydroxide and calcium oxide is in the range of 0.65 to 0.90,
   (e) adding a diluent oil;
   (f) separating solids from the liquid; and
   (g) stripping the solvent and alcohol from the resulting liquid product.

2. The process of claim 1 wherein the calcium hydroxide is added in mixture with calcium oxide.

3. The process of claim 1 wherein the calcium hydroxide is added with calcium oxide in a molar ratio of calcium hydroxide:calcium oxide of about 20:80 to 60:40.

4. The process of claim 1 wherein the calcium hydroxide is added with calcium oxide in a molar ratio of calcium hydroxide:calcium oxide of about 30:70 to 40:60.

5. The process of claim 1 wherein step (d) calcium hydroxide is added in amounts whereby the molar ratio of carbon dioxide to the sum of calcium hydroxide and calcium oxide is in the range of 0.77 to 0.80.

6. The process of claim 1 wherein the calcium hydroxide is added in 2 to 3 increments.

7. A process for preparing an overbased oil-soluble calcium sulfonate, comprising:
   (a) diluting a neutral calcium sulfonate with a light hydrocarbon solvent and a lower alkanol;
   (b) adding water and about 15 to 25 mole % of the total calcium hydroxide;
   (c) heating the resulting admixture to about 100° F. to 155° F. at pressure of about 1 to 5 atm;
   (d) introducing carbon dioxide into the heated admixture over a time of about 60 to 240 minutes while adding the remaining calcium hydroxide in amounts whereby the temperature in the admixture does not exceed 155° F.;
   (e) adding a diluent oil;
   (f) separating solids from the liquid; and
   (g) stripping the solvent and alcohol from the resulting liquid product.

8. The process of claim 7 wherein step (d) the temperature does not exceed 150° F.

* * * * *